United States Patent [19]

Streeter

[11] 4,302,626

[45] Nov. 24, 1981

[54] LOW FREQUENCY AM STEREOPHONIC BROADCAST AND RECEIVING APPARATUS

[75] Inventor: Robert D. Streeter, Fort Wayne, Ind.

[73] Assignee: Magnavox Consumer Electronics Company, New York, N.Y.

[21] Appl. No.: 779,392

[22] Filed: Mar. 21, 1977

[51] Int. Cl.[3] ..... H04H 5/00

[52] U.S. Cl. ..... 179/1 GS5; 329/122; 370/11; 455/61; 455/208; 455/214

[58] Field of Search ..... 325/36, 60, 61, 139, 325/419, 346, 47, 148; 179/15 BT, 15 BP, 15 BM, 1 GS; 343/200, 205; 329/122; 370/11; 455/61, 208, 214, 260

[56] References Cited

U.S. PATENT DOCUMENTS

| | | | |
|---|---|---|---|
| 2,851,532 | 9/1958 | Crosby | 358/144 |
| 3,068,475 | 12/1962 | Avins | 325/36 |
| 3,076,057 | 1/1963 | Baugh, Jr. | 179/15 BT |
| 3,087,995 | 4/1963 | Hellstrom | 332/37 |
| 3,109,896 | 11/1963 | Boothroyd | 455/233 |
| 3,143,600 | 8/1964 | De Vries | 179/15 BT |
| 3,160,812 | 12/1964 | Scantlin | 179/15 BM |
| 3,167,614 | 1/1965 | Holt et al. | 179/15 BT |
| 3,178,515 | 4/1965 | Bramer et al. | 179/15 BM |
| 3,218,393 | 11/1965 | Kahn | 325/36 |
| 3,358,240 | 12/1967 | McKay | 329/122 |
| 3,378,773 | 4/1968 | Jeffers | 455/109 |
| 3,393,380 | 7/1968 | Webb | 325/148 |
| 3,530,383 | 9/1970 | Sassler | 455/208 |
| 3,534,172 | 10/1970 | Weeda | 179/1 |
| 3,908,090 | 9/1975 | Kahn | 179/15 BT |
| 3,944,749 | 3/1976 | Kahn | 179/15 BT |
| 4,018,994 | 4/1977 | Kahn | 325/36 |
| 4,042,884 | 8/1977 | Querry | 329/122 |
| 4,079,204 | 3/1978 | Takahashi et al. | 179/15 BT |
| 4,093,824 | 6/1978 | Grosjean | 329/122 |

FOREIGN PATENT DOCUMENTS

| | | | |
|---|---|---|---|
| 2323658 | 11/1973 | Fed. Rep. of Germany | 325/36 |
| 540185 | 10/1941 | United Kingdom | 325/36 |

OTHER PUBLICATIONS

"Statement of John H. Dewitt, Jr., On Behalf of Clear Channel Broadcasting Service", pp. 17–19, Before the F.C.C., Nov. 22, 1976.

*Primary Examiner*—Marc E. Bookbinder
*Attorney, Agent, or Firm*—George R. Pettit

[57] ABSTRACT

Apparatus is described for transmitting and receiving stereophonic broadcasts in the low frequency commercial AM broadcast band. A transmitter is described which modulates the phase and amplitude of a broadcast signal with separate information signals. A pilot tone may also be included to identify the transmission as stereophonic. Receiving means for detecting the PM and AM components to derive separate signals for stereophonic reception are included.

7 Claims, 2 Drawing Figures

LOW FREQUENCY AM STEREOPHONIC BROADCAST AND RECEIVING APPARATUS

BACKGROUND OF THE INVENTION

This invention relates to a stereophonic system for AM broadcast transmitters and receivers. Specifically, apparatus is provided which is compatible with present AM modulated transmitting and receiving apparatus for transmitting two channels of information.

Two channel transmission incorporating FM modulation techniques are well known and widely used at frequencies above 50 MHz. It has been proposed by numerous authors to transmit two channels of information by means of amplitude modulation on a low frequency wave. The AM stations currently operating in the region of 550 KHz to 1600 KHz are not operated as stereo transmitting systems but remain as transmitters of monophonic information only. Therefore, it would be desirable to upgrade the quality of low frequency (550 KHz to 1600 KHz) amplitude modulated signals by including a second channel of information which could be received and demodulated to provide two channels of information for stereophonic reception.

Stereophonic systems for low frequency AM modulated transmitters must be compatible with present day transmitters and receivers of low frequency amplitude modulated signals. This is necessary in order to accommodate the millions of receivers in current use with new proposed stereophonic broadcasts.

A number of two channel systems have been proposed in the past which are compatible with monophonic transmitting and receiving equipment. One such system is described in *I.E.E.E. Transactions on Broadcasting,* Volume BC-17, No. 2, June 1971, pages 50–55. The system described in this particular paper transmits two signals comprising an L−R signal and an L±R signal. The L−R signal is phase shifted and then applied to a balanced modulator. A carrier signal is supplied to the balanced modulator and a double sideband, suppressed carrier signal is produced. The double sideband, suppressed carrier signal is added to a carrier signal which has been shifted 90 degrees. This composite signal comprising a carrier shifted at 90 degrees and a double sideband suppressed carrier signal is used as the basis for deriving an RF signal to be modulated with still another source of information L+R. The double sideband signal plus phase shifted carrier is frequency modulated to a suitable carrier frequency for transmission.

The frequency multiplied signal is AM modulated with a second source of signal, L+R, which is also phase shifted. The resulting composite signal includes a first sideband containing the left signal and a second sideband containing the right signal.

The transmitted two channel signal may be received by tuning two separate receivers to the first sideband and to the second sideband. By tuning in this manner, the L and R signals are recovered.

The system, however, does not achieve a high degree of isolation between channels, and cross talk is evident. The I.F. filter bandwidth and skirt slope is such that a portion of the upper sideband would necessarily enter the receiver passband which was tuned to the lower sideband. To achieve better isolation between information channels, the I.F. filter bandwidth must have very sharp skirts and a high stop band attenuation level.

Another system which has been described for transmitting stereophonic AM signals comprises an FM signal for carrying one signal channel, and a true AM modulation of the resulting FM modulated signal by the remaining signal channel. The modulated FM is derived by frequency modulating a carrier signal with pre-emphasized audio signal. A pre-emphasis network imparts a higher level to higher frequency audio signals than to lower frequency audio signals. The transfer function for the preemphasis network is directly proportional to the frequency of an input audio signal over the effective pre-emphasis bandwidth. In actual practice, the pre-emphasis network may be realized by operating an R−C high pass filter in the skirt region where the frequency response of the filter increases linearly. This give a positively increasing slope to the amplitude-frequency response of an audio signal which is used to modulate an FM modulator. The modulated signal has the characteristic of a PM signal rather than FM over the limited region of effectual pre-emphasis.

The resulting frequency modulated signal is supplied to an AM full carrier double sideband transmitter where it is modulated with a second audio signal. The composite FM/AM signal appears over a limited audio frequency range as a phase modulated signal with AM modulation impressed upon it, and as an FM signal with AM modulation over a limited low audio frequency range.

A shortcoming with the pre-emphasized FM/AM system has been experienced in that the pre-emphasis is obtained over a limited region of the input audio frequency spectrum. Where pre-emphasis is not effective, wide band FM occurs which is a potential source of distortion. The wide band FM resulting from limited pre-emphasis tends to cause FM-to-AM conversion in the tuned circuitry of the receiver. The conversion results from slope detection of the FM signals produced by the wide deviation of the audio signals in the FM system where pre-emphasis is not effective. The slope detection phenomenon causes the low frequency FM to be converted to an AM signal. The AM derived through slope detection of an FM signal thereafter will be detected in both channels thereby reducing the isolation between channels. Also, a true phase detector used to detect the PM component where pre-emphasis is effective will produce a nonlinear output where pre-emphasis is not effective. The principles of systems of this type are embodied in U.S. Pat. No. 3,068,475 and other references.

SUMMARY OF THE INVENTION

This invention provides apparatus for broadcasting and receiving stereophonic transmissions on frequencies currently used for AM broadcasting. The stereophonic transmissions are compatible with monophonic transmissions which are currently in use in the low frequency AM broadcasting spectrum, 550 KHz to 1600 KHz. Commercial receivers now available for receiving monophonic AM broadcasts will continue to receive full monophonic information from stereo broadcasts made by this invention.

To transmit stereophonic broadcasts, two separate modulation schemes are used to modulate a single radio frequency carrier operating in the low frequency AM broadcast region. Two sources of information representing stereophonic channels are used to modulate the radio frequency carrier in both AM and PM modes of modulation. In one embodiment, the two channels are combined to form a sum signal, the sum signal being used to amplitude modulate the carrier in a conventional double sideband full carrier modulation scheme. A difference channel is derived by subtracting the two channels and the difference channel is used to linearly modulate the phase of the radio frequency carrier at a low modulation index. In one embodiment of the invention, a pilot tone of different modulation index is also added to the phase modulated signal for identifying stereo broadcasts.

A receiver for demodulating stereo AM broadcasts is also provided whereby the AM component is separated to form one channel of information and the PM component separated to form another channel of information. The pilot tone is also recovered to provide an indication that the broadcast is being conducted in stereo. The pilot tone may also be used to carry information at a low frequency rate.

DESCRIPTION OF THE PREFERRED EMBODIMENT

Figure 1:
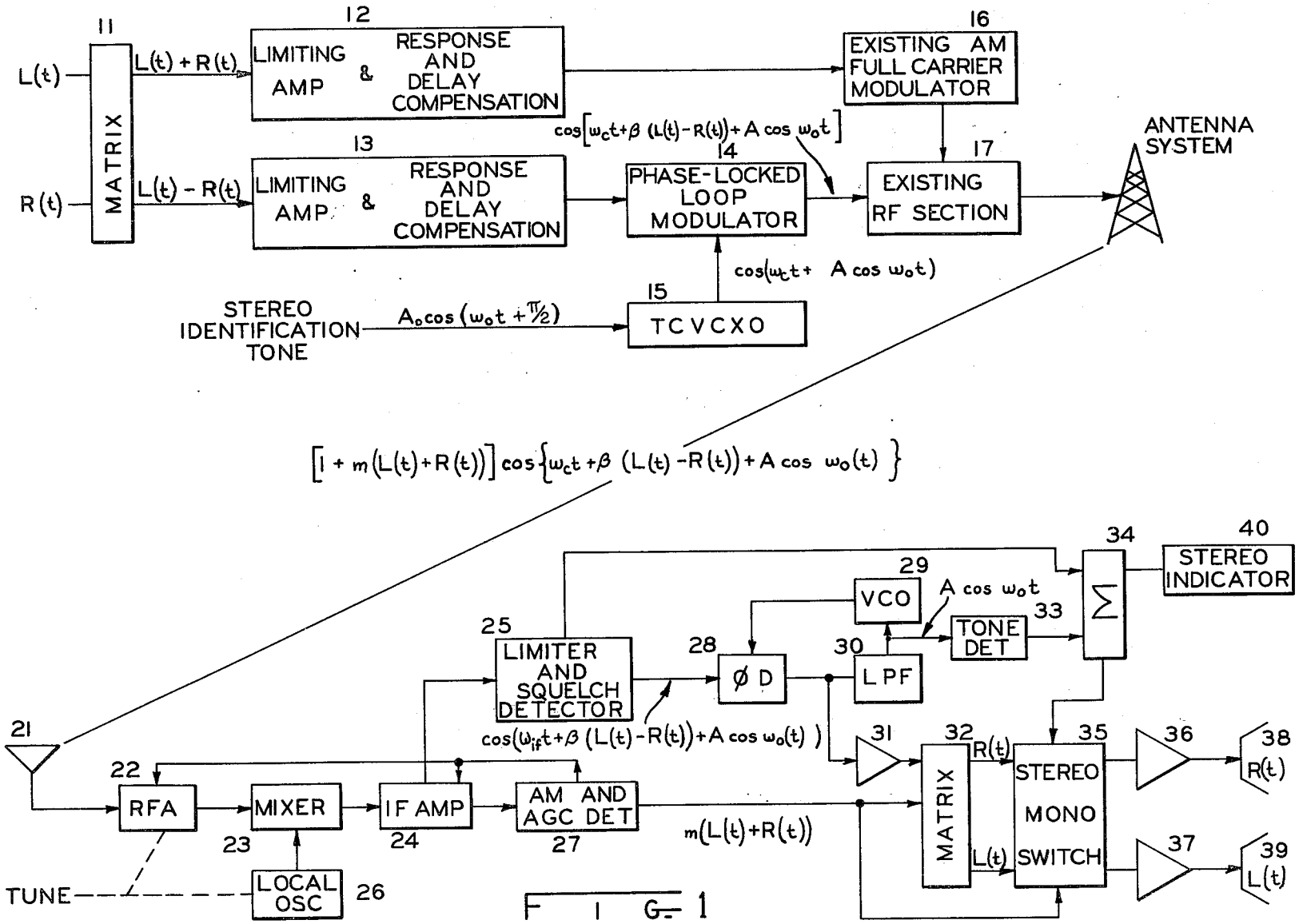
FIG. 1 is a block diagram illustrating transmitting and receiving apparatus in one embodiment of this invention.

Referring now to FIG. 1, there is shown both a transmitter and a receiver for transmitting stereophonic AM broadbcasts at low frequencies. Two channels of stereophonic information L (t) and R (t) are applied to the inputs of the transmitter for modulating a carrier. A matrix circuit 11 combines both channels of information to form a sum channel signal comprising (L(t)+R(t)) and a difference channel signal (L(t)−R(t)). L(t)−R(t) is applied to a limiting response and delay compensation network 13 whereby differences in group delay experienced by the summation and difference signals may be compensated. Similarly the summation signal (L(t)+R(t) is compensated by a limiting response and delay compensation network 12. These networks may compensate for any nonlinearity in either phase or amplitude experienced during either the transmission process or the receiving process of the summation and difference signals and prevent transmitter overmodulation. The output signal from the response and delay compensation network 13 is applied to the control input of a phase lock loop phase modulator 14. The phase lock loop modulator 14 comprises a phase detector, voltage control oscillator (hereinafter referred to as "VCO") and a loop filter. A temperature compensated crystal oscillator 15 (hereinafter referred to as TCVCXO) is compared by the phase detector in the phase lock loop 14 with the output of the VCO. The TCVCXO 15 in the embodiment shown is frequency modulated with a 5 Hz signal tone. The deviation of the TCVCXO is in the range of 20 Hz. The output from the phase lock loop modulator 14 may be represented by the following equation:

$$\cos\left(W_c t + B\left(L(t) - R(t)\right) + A \cos W_o t\right)$$

where

A is an arbitrary amplitude constant,

Wc is the carrier frequency

B is the highest PM modulation index for an audio signal to be modulated, and

A is the amplitude of the pilot tone having a frequency of Wo.

The signal produced by the phase lock loop modulator 14 is supplied to the input of a standard broadcast transmitter 17 operating in the 550 KHz to 1600 KHz range.

The resulting phase modulated signal is thereafter amplitude modulated with the summation signal (L(t)+R(t)) by means of a double sideband, full carrier modulator 16. The antenna feed network and antenna used for transmitting this composite AM and PM modulated signal must be designed so that the phase response as well as the frequency response over the bandwidth of interest is substantially flat to minimize distortion of the PM signal components which have been added to a standard AM carrier. By designing the antenna networks for constant group delay and linear phase response, distortions which may be added to the PM signal components are kept to a minimum.

Figure 2:
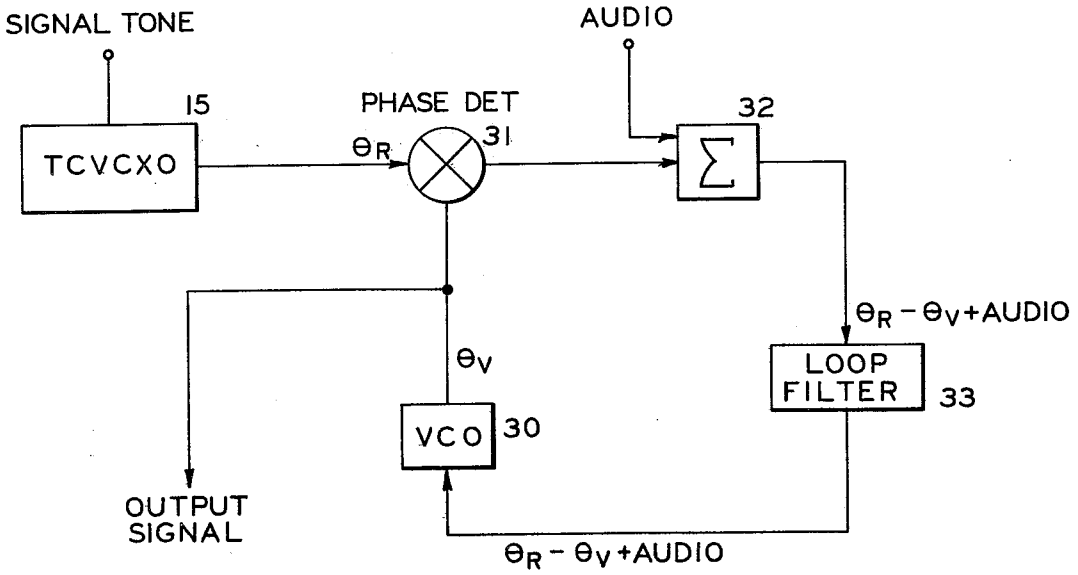
FIG. 2 is a block diagram illustrating one method for generating a phase modulated carrier.

The phase lock loop modulator scheme shown in FIG. 1 may be more completely understood by reference to FIG. 2. FIG. 2 illustrates in detail the combination of a phase lock loop modulator and a temperature compensated voltage controlled crystal oscillator (TCVCXO) for producing a signal which a voltage controlled oscillator (VCO) is made to follow. The phase lock loop shown in FIG. 2 is a second order phase lock loop having a bandwidth sufficient that the highest audio frequency in the modulating signal will cause a linear phase deviation of the VCO. A low pass filter 33 is used as the loop filter and its lead-lag characteristics are selected to yield the proper loop bandwidth. A VCO 30 has a control input connected to the output of the loop filter 33. The frequency and phase of the VCO 30 are controlled by the voltage supplied by the loop filter 33. A signal which ultimately determined the phase and frequency of VCO 30 is derived from the phase detector 31 which compares the phase of the TCVCXO 15 with the phase and frequency of VCO 30. As was previously indicated with reference to FIG. 1, TCVCXO 15 is frequency modulated with a signal tone of 5 HZ at a peak deviation of 20 Hz. VCO 30 in the embodiment shown will track this frequency modulation and the frequency of VCO 30 at any given moment will be that of TCVCXO 15. The phase of VCO 30 will, however, change according to the audio input applied to the summation circuit 32. The phase detector used should be linear over ±90°. Many digital phase detectors are available today which will yield the required phase linearity. The audio signal applied has frequency components below the loop bandwidth of the phase lock loop, therefore, the phase of VCO 30 will change linearly with the applied audio signal. The resulting output signal defined by the previous equation is thereafter applied to the AM carrier transmitter in a manner known to those in the art.

Although the specific embodiment contemplated the use of a phase lock loop for linearly modulating the phase of the carrier, other modulating schemes may be employed for this purpose. The general requirement for the modulator is that it produce a linear phase shift for a change in modulating voltage. Maintaining linearity is important in keeping distortion of the information being transmitted to a minimum.

Phase linearity can be improved by employing a phase modulator with a frequency multiplier. The phase modulator may be operated at a low deviation where phase linearity is best. Frequency multiplying the low deviated signal multiplies the phase deviation without a substantial increase in nonlinearity. Although the phase lock loop is sufficiently linear as a modulator, the possibility of improving linearity is to be noted by using the aforementioned frequency multiplication technique.

The phase modulated signal is thereafter amplitude modulated by the summation channel L(t)+R(t) signal to produce the following signal for transmitting:

$$[1+m(L(t)+R(t))]\cos(W_c(t)+B(t)-R(t))+A\cos W_o(t))$$

where m is the modulation index of the double sideband full carrier signal. Other terms of the equation have been previously defined. This signal is amplified in a known manner before applying the signal to an antenna for broadcasting.

Referring again to FIG. 1, a receiver for receiving the transmitted phase and amplitude modulated signal is shown. An antenna 21 directs the low frequency AM broadcasting signals to an rf amplifier and preselection circuit 22. The rf amplifier and preselection circuit 22 used in this receiver is similar to those in standard AM receivers. To preserve channel separation, the bandwidth for each tuned circuit should be greater than that of standard AM receivers so as to minimize loss of components in the PM signal which are distributed over a wider bandwidth than components of a standard AM signal. The preselection circuitry should be designed to have constant group delay over the passband in order to minimize any PM-to-AM conversion which a tuned circuit may cause. The output of the rf amplifier preselection circuit 22 goes to a standard mixer circuit 23 where it is heterodyned with the local oscillator signal from local oscillator 26. The local oscillator 26 should have better short-termed stability than standard AM receivers would normally have in order to reduce phase noise which limits the signal-to-noise ratio of a recovered phase modulated signal. An ideal short-term stability for the local oscillator of less than 1/1000 of a radian above 100 Hz is desired. Although this represents a design goal, considerably less stability will produce an acceptable demodulated audio signal.

The heterodyned output from the mixer 23 is applied to a standard IF amplifier 24 which has a passband sufficient to accommodate the sidebands produced by the PM modulation, and has a substantially constant group delay to reduce the possibility of PM to AM conversion. The IF amplifier is controlled by an AGC voltage as is the rf amplifier. This AGC control is standard in most AM receivers today. An AM detector and AGC detector 27 derive the AGC voltage from the IF amplifier 24 in a known way. The AM detector signal L(t)+R(T) is thereafter supplied to a Matrix circuit 32.

The IF amplifier also supplies a limiter-squelch circuit 25 with a composite AM and PM modulated signal. The limiter is a standard limiter found in many FM receivers today. The limiter effectively removes most of the amplitude modulation which appears on the signal supplied by IF amplifier 24. The output of the limiter containing a phase modulated signal is applied to a phase detector 28. The phase detector 28 is employed in a phase lock loop comprising VCO 29 and low pass filter 30. The phase lock loop is a second order loop known to those skilled in the art with a loop bandwidth of approximately 50 Hz. The low-pass filter is selected to give the lead lag characteristics sufficient to attain this bandwidth. The phase lock loop keeps VCO 29 locked in frequency and phase to the incoming signal. Because the loop filter bandwidth was selected to be 50 Hz, the VCO will track the frequency modulated signal tone which is being transmitted. The phase modulated audio which is transmitted will appear at the output of phase detector 28. The VCO 29 will not track the phase modulated audio to the extent that the low frequency signal tone is tracked because of the limited loop bandwidth.

A tone detector 33 which may consist of a filter (analog or digital) tuned to the 5 Hz signal tone frequency is used to supply an output indicative of the reception of a stereo broadcast from the AM transmitter. This tone detector output is supplied to a summation circuit 34 where it is summed with the output from the squelch circuit 25.

The low frequency audio having been recovered by phase detector 28 is amplified by amplifier 31. The amplified signal which may be represented by L(t)−R(t) is combined with L(t)+R(t) in Matrix 32 to yield the L(t) and R(t) signal. The L(t) signal is supplied through a stereo mono switch 35 to an amplifier 37 and speaker 39. This constitutes one signal of the stereophonic transmission. The gain of amplifier 31 must be adjusted so that the matrix 32 will provide an R(t) signal and L(t) signal by combining the summation signal L(t)+R(t) in a known way with difference signal L(t)−R(t). Those skilled in the art will recognize that the amplification factor of amplifier 31 will depend in part upon the level of signal being supplied by the AM detector. An AGC circuit which has a wide dynamic range will tend to minimize the changes in the AM detector output level, thereby allowing the amplification factor for amplifier 31 to be a constant. Those skilled in the art will also recognize that the gain of amplifier 31 may also be made a function of AGC level thereby automatically compensating for changes in the level of signal produced by the AM detector.

During the reception of a PM modulated signal, this Matrix 32 derives the first and second information signals in a stereophonic broadcast. The limiter-squelch circuit 25 provides an output when the limiter has dropped out of limiting due to a loss of signal, or due to high negative peaks in the AM modulation. This loss of signal results in no signal being supplied to the phase detector 28. Accompanying this loss of signal will be the generation of a burst of noise which will be objectionable when processed through the amplifier 36 and speaker 38. Therefore, a squelch circuit having very rapid response time is used to provide a signal for disabling the stereo reception mode and enabling the receiver to receive monophonic information. The summation circuit 34 will cause the stereo mono switch 35 to make the requisite change to a monophonic reception when the tone detector detects that only a monophonic transmission is being originated by the transmitter, or when the aforementioned loss of signal occurs at the limiter output. Either of these two conditions will cause an indicator 40 to indicate the lack of stereo broadcast and will also cause the stereo mono switch to connect the summation signal L(t)+R(t) derived from the AM detector to the inputs of amplifiers 36 and 37.

Those skilled in the art will recognize other circuits for causing the receiver to switch from a stereophonic to a monophonic mode of operation. For instance, a matrix network may be used which receives a first input of (L(t)+R(t)) and a second input (L(t)−R(t)). As long as both inputs are receiving a signal, the matrix provides an output of R(t) and L(t). However, when the L(t)−R(t) signal is zero, the matrix will provide two output signals of L(t)+R(t).

Thus, there has been described with respect to both a transmitter and receiver a system for providing stereophonic AM broadcasts at low frequencies. The technique is fully compatable with standard AM broadcasts which are not stereophonic, and receivers now in existance which are strictly monophonic will receive the AM component of the transmitted stereo signal of this invention as before, and the additional channel will remain undetected. This compatability between the stereophonic broadcasts of this invention and the AM broadcasts of monophonic information currently in use will be appreciated by those skilled in the art.

The invention has been described in this embodiment with reference to a signal tone which is a five cycle sine wave which may be used to identify that a stereo transmission is being received. It will be appreciated that signal tone could be replaced by an information carrying signal at a very low frequency data rate. The information carrying signal could be used to transmit the call letters or some other information which would be received over a long time period thus in effect giving three channels of information rather than two as previously described.

Thus, there has been described a new system for transmitting stereo broadcasts in a low frequency AM broadcast spectrum. Those skilled in the art will recognize other embodiments described more particularly by the claims that follow.

What is claimed is:

1. A receiving apparatus for removing stereophonic information contained in a broadcast signal comprising:

(a) means for providing a broadcast signal, said broadcast signal having a phase linearly modulated with a first audio signal, and amplitude modulated with a second audio signal, and frequency modulated with a third low frequency audio signal;

(b) detector means for supplying a signal proportional to the amplitude modulation of said broadcast signal;

(c) phase detector means for providing a signal proportional to the variation in phase of said broadcast signal; and (d) means for providing a signal proportional to the variation in frequency of said broadcast signal.

2. A receiving system for demodulating a broadcast signal modulated in amplitude by a summation signal (L(t)+R(t)), modulated in phase by a difference signal (L(t)−R(t)), and modulated in frequency by a low frequency identifying signal comprising:

(a) a tuned circuit amplifier means for receiving said broadcast signal;

(b) conversion means for converting said broadcast signal to an intermediate frequency signal;

(c) an amplifier for amplifying said intermediate frequency signal;

(d) an amplitude detector for removing said summation signal L(t)+R(t) from said intermediate frequency signal;

(e) limiter means for maintaining the amplitude of said intermediate frequency signal constant;

(f) phase demodulator means for providing a signal in response to the change in phase of said limiter means output signal, said phase demodulator means having an output signal proportional to said L(t)−R(t) signal;

(g) means for maintaining said phase demodulator means output signal at a fixed amplitude with respect to said amplitude detector output signal;

(h) means for combining said phase demodulator means output signal with said amplitude detector output signal whereby a first audio signal L(t) and a second audio signal R(t) are produced; and (i) frequency demodulator means for providing a signal proportional to said low frequency identifying signal.

3. The apparatus of claim 2 further comprising means for amplifying said R(t) signal to a level for driving an electroacoustical transducer.

4. The apparatus of claim 3 further comprising means for amplifying said L(t) signal to a level for driving an electroacoustical transducer.

5. The apparatus of claim 4 further comprising squelch means for detecting when said limiter is not providing an output signal, and means for supplying said summation signal L(t)+R(t) to said means for amplifying said L(t) signal and to said means for amplifying said R(t) signal in response to said squelch means.

6. In an apparatus for receiving a composite modulated signal, said signal being frequency modulated by a low frequency signal tone and phase modulated by an audio signal, means for separating said audio signal and said low frequency signal tone from said composite modulated signal comprising:

(a) a voltage controlled oscillator having an output signal, the phase and frequency of said output signal being proportional to an applied control voltage;

(b) a phase detector for providing a signal porportional to the difference between the phase of said voltage controlled oscillator output signal and the phase of said composite modulated signal;

(c) a lowpass filter for receiving said phase detector output signal, said filter being operatively connected to said voltage controlled oscillator for supplying a control voltage to said oscillator whereby said voltage controlled oscillator is caused to change frequency in accordance with said low frequency signal tone;

(d) means for detecting the control voltage of said voltage controlled oscillator, said control voltage being proportional to said low frequency signal tone; and (e) means for detecting the output signal of said phase detector, said detected output signal being proportional to said audio signal.

7. In a stereophonic broadcasting system comprising a carrier frequency signal being linearly modulated in phase by a difference audio signal R(t)−L(t), modulated in amplitude by a summation signal R(t)+L(t) and modulated in frequency by a signal tone having a frequency of Wo, a receiver for demodulating said broadcast signal comprising:

(a) a tuned amplifier for amplifying a portion of said broadcast signal;

(b) conversion means for converting an amplified broadcast signal into an intermediate frequency signal;

(c) a limiter circuit for removing amplitude variations in said intermediate frequency signal;

(d) phase detector means operatively connected to said limiter circuit for producing an output signal proportional to said difference audio signal R(t)−L(t);

(e) amplitude detector means operatively connected to said conversion means for producing an output signal proportional to said summation audio signal R(t)+L(t);

(f) matrix means for combining said amplitude detector means output signal and said phase detector output signal whereby first and second audio signals proportional to R(t) and L(t) are produced; and (g) frequency modulation detector operatively connected to said phase detector means for providing a signal proportional to said signal tone.

* * * * *

UNITED STATES PATENT AND TRADEMARK OFFICE

CERTIFICATE OF CORRECTION

PATENT NO. : 4,302,626

DATED : November 24, 1981

INVENTOR(S) : Robert D. Streeter

It is certified that error appears in the above—identified patent and that said Letters Patent is hereby corrected as shown below:

Column 1, line 38, delete "L$\underline{+}$R" and insert --L+R-- line 50, delete "modulated" and insert --multiplied--

Column 2, line 16, delete "give" and insert --gives--

Column 3, line 65, delete "A is an arbitrary amplitude constant,"

Column 5, line 9 and 10 delete "$[1 + m(L(t) + R(t))] \cos (W_c(t) + B(t) - R(t)) + A \cos W_o(t))$" and insert --$[1 + m(L(t) + R(t))] \cos (W_c(t) + B(L(t) - R(t)) + A \cos W_o(t))$--

Column 5, line 53 delete "L(t) + R(T)" and insert --L(t) + R(t)--

Signed and Sealed this

Sixth Day of July 1982

[SEAL]

Attest:

GERALD J. MOSSINGHOFF

Attesting Officer

Commissioner of Patents and Trademarks